United States Patent [19]

Romanelli et al.

[11] Patent Number: 4,784,170

[45] Date of Patent: Nov. 15, 1988

[54] FUEL INJECTOR CLEANER KIT

[76] Inventors: Patrick Romanelli; Robert J. Romanelli, both of 242 Brook St., Harrington, N.J. 07640

[21] Appl. No.: 55,005

[22] Filed: May 28, 1987

[51] Int. Cl.[4] ..... B08B 3/08; B08B 9/00; F02B 77/04

[52] U.S. Cl. ..... 134/113; 123/198 A; 134/169 A

[58] Field of Search ..... 134/113, 169 A; 123/1 A, 198 A; 206/232; 62/292

[56] References Cited

U.S. PATENT DOCUMENTS 4,606,311 8/1986 Reyes et al. ..... 134/169 A X
4,671,230 6/1987 Turnipseed ..... 134/169 A X

OTHER PUBLICATIONS

Automotive Parts & Accessories, J. C. Whitney & Co., Catalog No. 419B, 1982, p. 222.

*Primary Examiner*—Philip R. Coe
*Attorney, Agent, or Firm*—Thomas R. Morrison

[57] ABSTRACT

A fuel injector cleaning kit includes a pressurized container containing a pressurized mixture of a fuel injector cleaning fluid and a motor vehicle fuel. The kit includes instructions, hoses and adapters for connection to a plurality of different motor vehicles. An adjustable pressure regulator, included as part of the kit, controls the pressure of the mixture delivered to the vehicle to a value specific to the particular vehicle.

11 Claims, 4 Drawing Sheets

FUEL INJECTOR CLEANER KIT

BACKGROUND OF THE INVENTION

The present invention relates to fuel injector cleaner systems for motor vehicles, and, more particularly, to kits comprising elements used in cleaning fuel injectors.

Fuel injectors are used in motor vehicles for introducing fuel directly into the manifold or cylinders of an internal combustion engine. Over time, a fuel injector normally build up a deposit of carbon, or other contaminants, in its fuel-flow passage which degrade the operation of the fuel injector, resulting in inferior engine performance.

It is conventional to replace partially clogged fuel injectors to restore engine performance. Such replacement is costly both in materials and labor.

A preferred solution is a technique for cleaning fuel injectors in place in the engine. U.S. Pat. Nos. 4,520,773 and 4,606,311 disclose a cleaning system wherein the functions of the vehicle fuel pump are assumed by an external fuel pump provided on a service cart. These patents disclose electrical control of the fuel injectors from devices on the cart external to the engine. In essence, these inventions require duplication of the fuel-injection system except for the injectors and some of the piping.

The apparatus disclosed in the referenced patents is complex, costly and unsuitable for use by other than fully skilled mechanics having the requisite equipment and space available for storing it.

It appears to be desirable to provide an inexpensive fuel injector cleaning apparatus without the need for bulky and expensive equipment. For commercial viability, an automotive after-market product should be adaptable for use in as many different types of motor vehicles as possible. As is well known, most motor vehicle manufacturers in the United States and foreign countries have developed unique techniques for connecting together the elements of a fuel system. Thus, a problem exists in developing a fuel-injector cleaning product capable of being used with virtually all engines from all manufacturers.

OBJECTS AND SUMMARY OF THE INVENTION

Accordingly, it is an object of the invention to provide a fuel injector cleaning system which overcomes the drawbacks of the prior art.

It is a further object of the invention to provide an inexpensive and relatively easy-to-use fuel injector cleaning system.

It is a still further object of the invention to provide a fuel injector cleaning system which is adaptable for use in cleaning a wide variety of fuel injectors.

Briefly stated, there is provided a fuel injector cleaning kit having a pressurized container containing a pressurized mixture of a fuel injector cleaning fluid and a motor vehicle fuel. The kit includes instructions, hoses and adapters for connection to a plurality of different motor vehicles. An adjustable pressure regulator, included as part of the kit, controls the pressure of the mixture delivered to the vehicle to a value specific to the particular vehicle.

According to an embodiment of the invention, there is provided a kit for cleaning fuel injectors in a plurality of different motor vehicles comprising: a pressurized container of a mixture of a cleaning fluid and a fuel for the motor vehicle, a pressure regulator, at least a first coupling means for coupling the pressure regulator to the pressurized container, second coupling means for coupling an outlet of the pressure regulator to the fuel injectors, the second coupling means including at least first and second different adapters for coupling to the fuel injectors in respective ones of the different motor vehicles, and the pressure regulator including controllable means for regulating a pressure of the mixture at the outlet to a value appropriate for a particular motor vehicle to which it is coupled.

According to a feature of the invention, there is provided a kit for cleaning fuel injectors in at least first and second different motor vehicles, comprising: a pressurized container, a pressurized mixture of a cleaning fluid and a fuel in the pressurized container, a pressure regulator, first coupling means for coupling the mixture to the pressure regulator, second coupling means for coupling the pressure regulator to one of the at least first and second different motor vehicles, the second coupling means including at least first and second hoses and at least first and second adapters, and the pressure regulator including adjustable means for regulating a pressure of the mixture fed to the motor vehicle to a value appropriate for the one of the at least first and second different motor vehicles.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
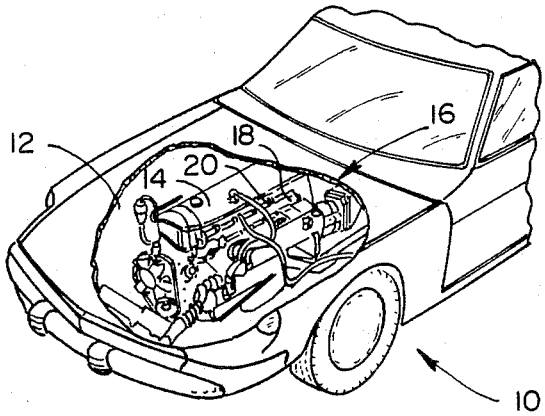
FIG. 1 is a perspective view, partly cut away, of a motor vehicle containing a fuel injector system to which reference will be made in describing the present invention.

Referring now to FIG. 1, there is shown, generally at 10, an automobile with which fuel injector cleaner kit of the present invention may be employed. An engine compartment 12 contains an engine 14 having a fuel system 16 mounted thereon and operatively associated therewith. A fuel system 16 includes, among other elements, a fuel distribution manifold 18 feeding fuel to a plurality of fuel injectors 20.

Figure 2:
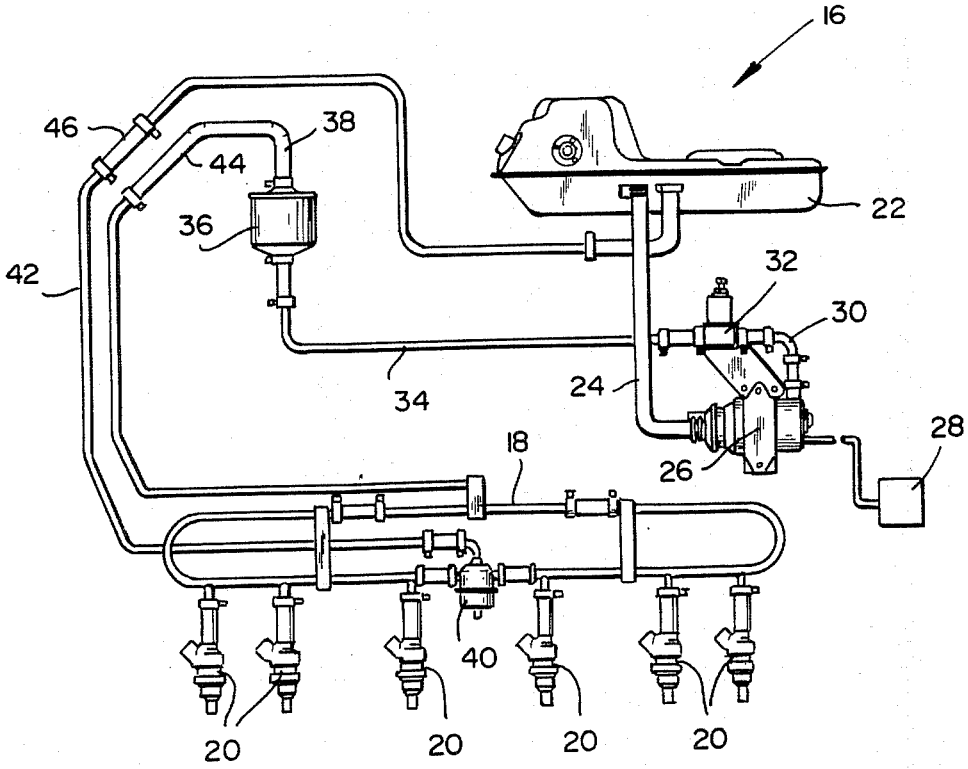
FIG. 2 is a schematic diagram of a fuel system of the motor vehicle of FIG. 1.

Referring now to FIG. 2, fuel system 16 includes a fuel tank 22 supplying fuel as needed through a fuel conduit 24 to a fuel pump 26. Fuel pump 26 is energized by a fuel pump relay 28 to provide pressurized fuel through a fuel conduit 30 to a fuel pressure regulator 32.

The fuel continues through a fuel conduit 34, a fuel filter 36 and a further fuel conduit 38 to fuel distribution manifold 18.

Pressurized fuel is connected by fuel distribution manifold 18 to all fuel injectors 20. A return pressure regulator 40 permits excess fuel from fuel distribution manifold 18 to return via a fuel return conduit 42 to fuel tank 22. A rubber hose 44 is conventionally employed as part of fuel conduit 38 to facilitate installation and removal of fuel conduit 38. In addition, a rubber hose 46 is also conventional in rubber hose 46 of some automobiles.

One skilled in the art will understand that the particular arrangement of fuel system 16 in FIG. 2 is exemplary only. The actual arrangements vary widely in vehicles from different manufacturers. However, the basic elements illustrated are generally present.

Figure 3:
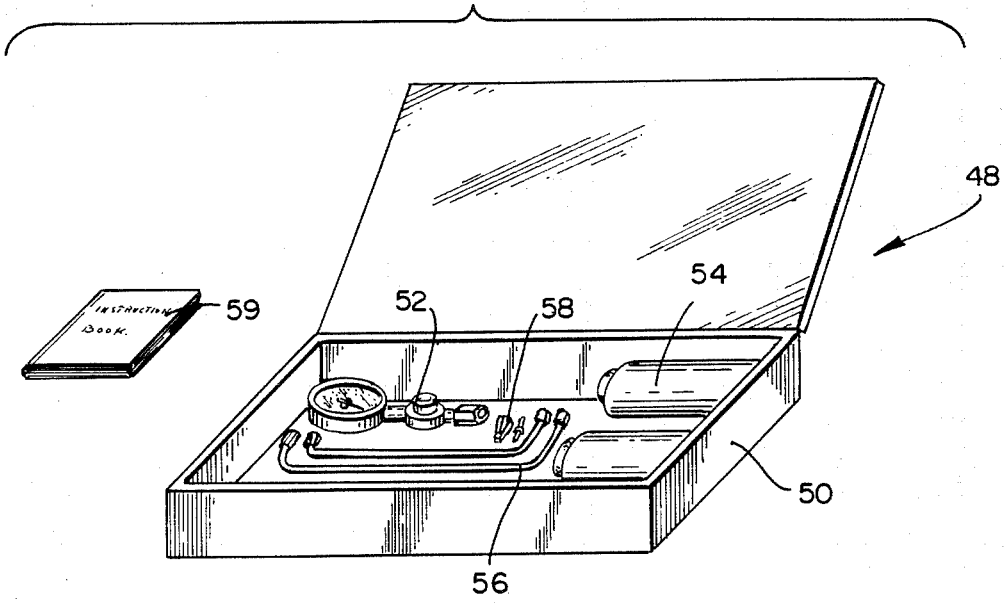
FIG. 3 is a perspective view of a fuel injector cleaner kit according to an embodiment of the invention.
Figure 5A:
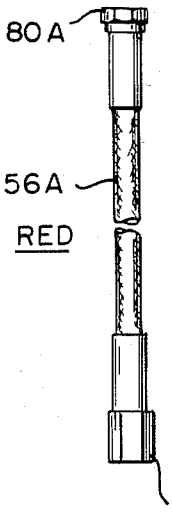
FIGS. 5A–5D are side views of a plurality of hoses in the fuel injector cleaner kit of FIG. 3.
Figure 5B:
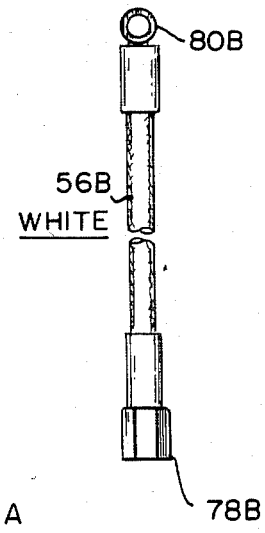
Figure 5C:
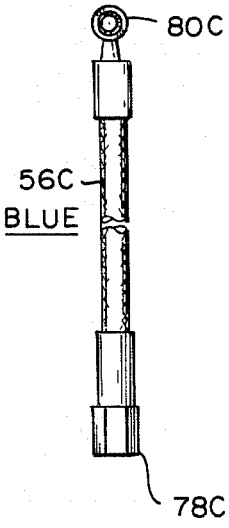
Figure 5D:
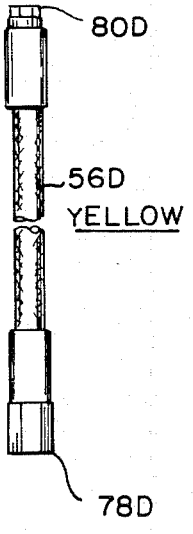

Referring now also to FIG. 3, there is shown, generally at 48, a fuel injector cleaner kit capable of cleaning fuel injectors 20 of most production automobiles having fuel injection. Fuel injector cleaner kit 48 includes a box 50 containing a pressure regulator and pressure gauge assembly 52, at least one pressurized container 54 containing a mixture of automotive fuel and fuel injector cleaner, a plurality of flexible hoses 56 and a plurality of adapters 58. An instruction manual 59, included as part of fuel injector cleaner kit 48, contains instructions for assembling individual elements from fuel injector cleaner kit 48 into a selected assembly adapted to a particular make, model and year motor vehicle. The cleaner may be of any suitable type such as, for example, mixture of aromatic petroleum distillate and butyl cellulose. The ratio of cleaner to automotive fuel is selected to permit engine 14 to run powered by the fuel while the flow of the mixture delivers the cleaner to the fuel injectors. A mixture of about two parts fuel to about one part cleaner may be satisfactory. As is more fully developed hereinafter, proper selection of the above elements, augmented with possible additional optional devices, permits cleaning of virtually every type of fuel injector without requiring removal from the vehicle nor an external cart-supported electrical and mechanical system.

In normal operation, fuel pump 26 is driven under control of fuel pump relay 28 to produce a flow of fuel whose pressure is regulated by fuel pressure regulator 32 before passing through fuel filter 36 and fuel distribution manifold 18 to fuel injectors 20. For cleaning fuel injectors 20 with fuel injector cleaner kit 48, fuel pump 26 is disabled by, for example, disconnecting it from fuel pump relay 28. A pre-mixed mixture of motor-vehicle fuel and fuel-injector cleaner in pressurized container 54 is supplied at a precise pressure controlled by pressure regulator and pressure gauge assembly 52 to fuel injectors 20 by, for example, disconnecting rubber hose 44 at fuel filter 36 and connecting an outlet of pressure regulator and pressure gauge assembly 52 to the free end of rubber hose 44, aided by a selected combination of flexible hoses 56 and adapters 58. Some vehicles provide fittings on fuel distribution manifold 18, or other elements in fuel system 16 to which direct mechanical connection can be made with suitable ones of flexible hoses 56 and adapters 58 without relying on disconnection of rubber hose 44. Fuel return conduit 42 is blocked during the cleaning operation to prevent return flow of the fuel/cleaner mixture into fuel tank 22, where it could cause damage. Blocking of fuel return conduit 42 may be done in some vehicles by placing a clamp (not shown) on rubber hose 46. In other vehicles a removable fitting is disconnected and a plug, optionally supplied as part of fuel injector cleaner kit 48, is employed to block fuel return conduit 42.

Some motor vehicles employ two fuel pumps; one of which is a low-pressure fuel pump (not shown) located near fuel tank 22, and the other of which corresponds to fuel pump 26 in or near engine 14. In such an installation, both fuel pumps must be disabled before using fuel injector cleaner kit 48.

The fuel pressures required vary widely from as little as 10 to as high as 55 PSIG for different makes and models of vehicles. In addition, the consequences of supplying the fuel/cleaner mixture at an incorrect pressure are severe. Insufficient pressure may prevent effective cleaning and may provide insufficient fuel to permit the engine to run for driving the cleaning operation. Excessive pressure may cause damage in fuel conduit 38, fuel distribution manifold 18 or fuel injectors 20. The danger of excessive pressure is exacerbated by the need to block fuel return conduit 42 for preventing the mixture from returning to fuel tank 22. As a consequence, close pressure control at any selectable pressure over an extremely wide range is a vital requirement. Such selectable pressure is provided by pressurizing pressurized container 54 with a propellant with a pressure substantially greater than the highest pressure required by any motor vehicle to be serviced by fuel injector cleaner kit 48. Pressure reduction by pressure regulator and pressure gauge assembly 52 is then capable of delivering any required pressure.

Figure 4:
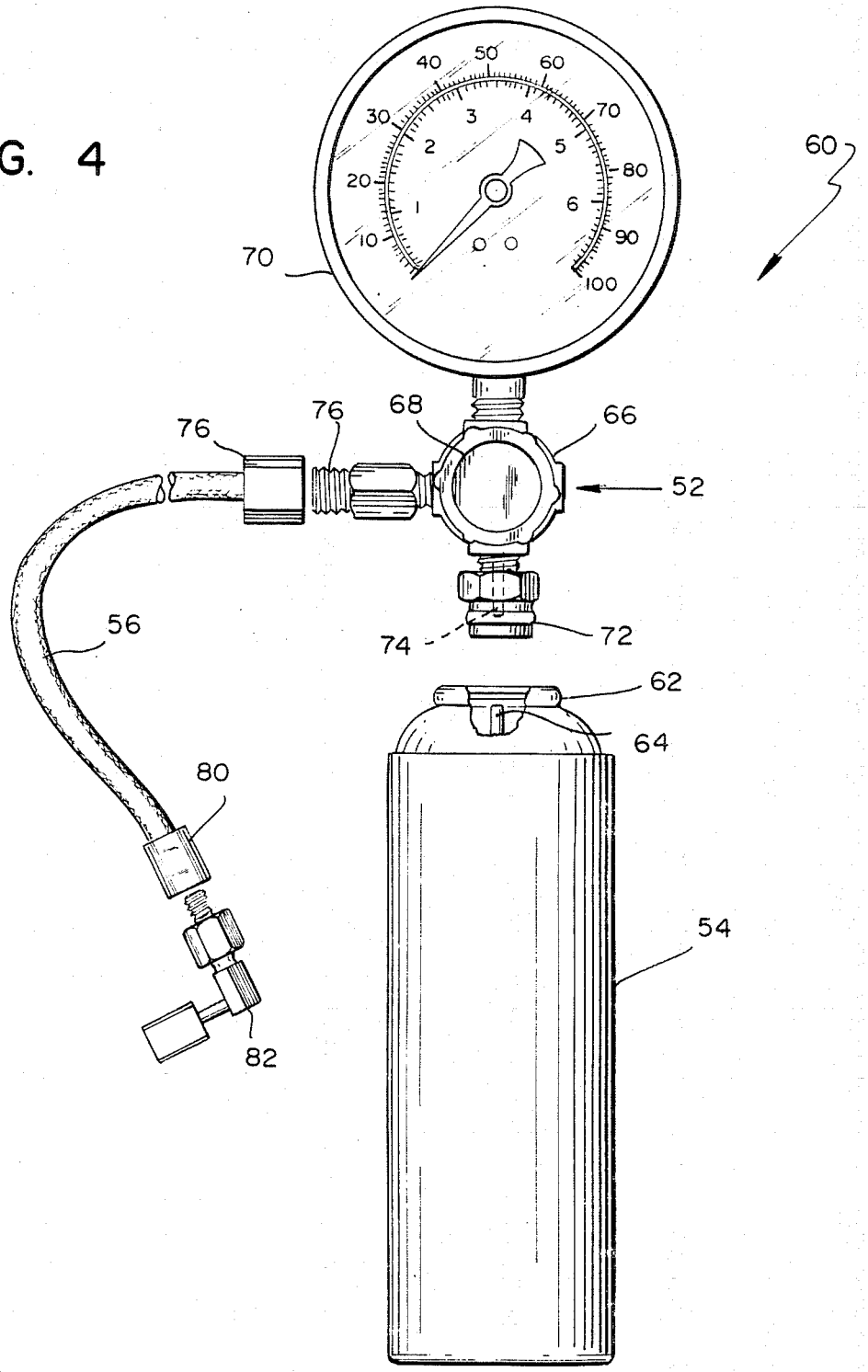
FIG. 4 is a front view of a selected fuel injector cleaner assembly selected from the fuel injector cleaner kit of FIG. 3, according to instructions in an instruction manual included with the kit.

In greater detail now, referring to FIG. 4, there is shown, generally at 60, a selected fuel injector cleaner assembly, in accordance with an embodiment of the invention. Selected fuel injector cleaner assembly 60 is assembled from selected ones of the elements in fuel injector cleaner kit 48 (FIG. 3) according to the instructions in instruction manual 59.

Pressurized container 54 includes a threaded neck 62, and a valve 64. A suitable receptacle containing a preferred cleaning fluid is sold by Ram Products Inc. of Northvale, N.J., assignee herein, under the trademark RAM 903'.

Pressure regulator and pressure gauge assembly 52 includes a pressure regulator 66 controllable by a control knob 68, and a pressure gauge 70. A threaded coupling 72, threaded to engage threaded neck 62, includes an actuator 74 centrally disposed therein. As threaded coupling 72 and threaded neck 62 are engaged, actuator 74 actuates valve 64, thereby making the pressurized fluid within pressurized container 54 available to pressure regulator and pressure gauge assembly 52. An exit port 76 includes threads on a surface thereof connectable to a pressure fitting 78 on a first end of a selected one of flexible hoses 56. A second pressure fitting 80 on flexible hose 56 is connectable to an end of a selected adapter 82. The other end of adapter 82 is adapted for connection to a particular point in a particular motor vehicle, following instructions in instruction manual 59.

It is contemplated that certain of flexible hoses 56 provided in fuel injector cleaner kit 48 may be directly connectable to the motor vehicle without requiring an intermediate adapter 82. The availability of relatively inexpensive adapters 82 permits expansion of the utility of a relatively more expensive flexible hose 56, whereby an overall cost tradeoff for minimizing total cost of fuel injector cleaner kit 48 is possible.

By way of example, the illustrated selected fuel injector cleaner assembly 60 shows a configuration suitable for cleaning the fuel injectors of a Chrysler Multi-Port automobile, a 1975–79 Cadillac, a GM TBI or a GM late model Multi-Port automobile. Other possible configurations are detailed below.

Referring now to FIGS. 5A–5D, a plurality of flexible hose 56A–56D are shown. Each flexible hose 56 includes a pressure fitting 78 for connection to exit port 76 of pressure regulator and pressure gauge assembly 52. Each has a second pressure fitting 80 for connection directly, or through an adapter, to the fuel system of a motor vehicle. Flexible hose 56A, for example, is the one that was selected for illustrated in FIG. 4. It will be noted that each of flexible hoses 56A–56D has a color listed alongside it. It has been found that the instructions in instruction manual 59 (FIG. 3) are simplified by the availability of an identifying color to specify this part of selected fuel injector cleaner assembly 60. The colors red, white, blue and yellow are convenient for the vividness with which they can be presented in a band or a plastic coating. It should not be presumed, however, either that color is a necessary element of all embodiments of the invention or that solid colors are the only possibility. An embodiment of the invention is foreseen in which one or more stripes of contrasting color are employed on a colored or plain background to aid in identifying a particular flexible hose 56.

The second end of each of flexible hoses 56A–56D includes a unique pressure fitting 80A–80D adapted for connection to the fuel system of a motor vehicle, either directly, or through one or another alternative adapters.

Referring now to FIGS. 6A–6L, there are shown respective different types of adapter 82. Each pressure fitting 80A–80D couples to at least one type of adapter 82, and may be configured to couple to two or more adapters 82 for adapting fuel injector cleaner kit 48 to two or more different types of motor vehicles.

For specificity, the illustrated elements may be combined in the following permutations for cleaning fuel injectors in the specified motor vehicles:

flexible hose 56A:

- adapter 82D—Mercedes MPC; BMW AFC; Fiat AFC; Jaguar MPC or AFC; Porsche MPC or AFC; Renault MPC or AFC; Saab MPC; VW MPC or AFC; Volvo MPC or LH; and Chrysler TBI (with adapter 82F)
- adapter 82E—Mercedes MPC; BMW AFC; Fiat AFC; Jaguar MPC or AFC; Porsche MPC or AFC; Renault MPC or AFC; Saab MPC; VW MPC or AFC; Volvo MPC or LH; and Datsun AFC
- adapter 82H—GM 4 cylinder TBI (with adapter 82I)
- adapter 82J—Ford TBI low-pressure, high-pressure or multi-port (with adapter 82K and L)

flexible hose 56B:

- adapter 82A—Audi CIS; BMW CIS; Mercedes CIS; Porsche CIS; Saab CIS; VW CIS; Volvo CIS (each with adapter 82B) and Toyota flexible hose 56C:

- adapter 82A—Toyota

These representative permutations enable those of ordinary skill in the art to combine the illustrated components to clean fuel injectors in almost any kind of motor vehicle.

Figure 6A:
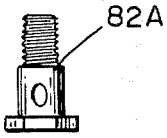
FIGS. 6A–6L are side views of a plurality of adapters supplied with the fuel injector cleaner kit of FIG. 3.
Figure 6G:
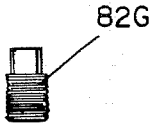
Figure 6B:
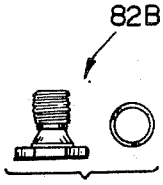
Figure 6H:
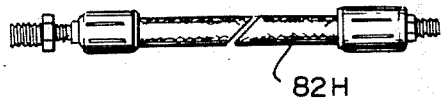
Figure 6C:
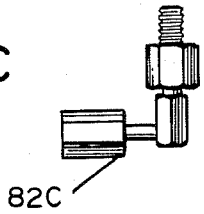
Figure 6I:
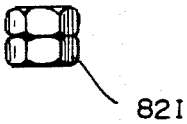
Figure 6D:
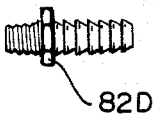
Figure 6J:
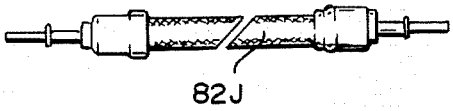
Figure 6E:
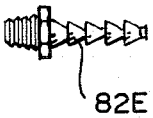
Figure 6K:
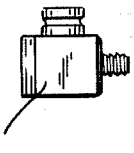
Figure 6F:
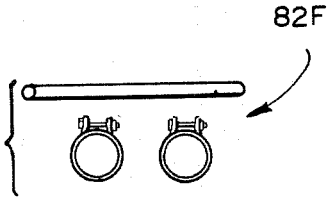
Figure 6L:
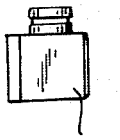
Figure 6M:
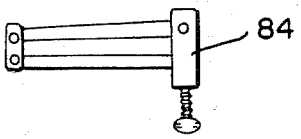
FIG. 6M is a side view of a clamp optionally supplied with the fuel injector cleaner kit of FIG. 3.

In use, selected fuel injector cleaner assembly 60 is connected to a location in the fuel system indicated using the particular flexible hose 56 and adapter 82 indicated in instruction manual 59 for the particular motor vehicle being treated. Fuel pump 26 is disabled by, for example, removing electrical power therefrom. Fuel return conduit 42 is blocked to prevent the cleaning mixture from backing up into the fuel tank. This may be done by means of a girling tool or a vise grip pliers, or by using a clamp 84 (FIG. 6M) optionally provided in fuel injector cleaner kit 48 for that purpose.

Control knob 68 is turned to the fully OFF position. Pressurized container 54 is attached to threaded coupling 72. This opens valve 64, thus making the pressurized mixture in pressurized container 54 available to pressure regulator 66. Due to the OFF position of control knob 68, none of the mixture is released at this time.

Control knob 68 is turned until a pressure specified in instruction manual 59 for the particular motor vehicle is registered on pressure gauge 70. The engine is then started and run at between about 800 and 2500 RPM fueled by the fuel content of pressurized container 54 until substantially all of the mixture has passed through the fuel injectors. When the mixture is exhausted, the motor slows and stops. Near the end of the running period, a minor adjustment of control knob 68 may help maintain the pressure near the specified value.

After the engine stops, it is allowed to rest for from five to ten minutes, to permit the cleaning fluid to loosen any heavy deposits of dirt that may have accumulated prior to cleaning.

Control knob 68 is reset to zero to prevent leakage of any residual mixture in pressurized container 54. Selected fuel injector cleaner assembly 60 is removed and normal fuel and electrical connections are restored. Fuel pump 26 is run for from ten to thirty seconds, to bring the fuel pressure up to operating specifications.

After these steps are performed, the fuel injectors are clean, and normal engine function is restored.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A kit for cleaning fuel injectors in a plurality of different motor vehicles comprising:

a pressurized container of a mixture of a cleaning fluid and a fuel for said motor vehicle;

a pressure regulator;

at least a first coupling means for coupling said pressure regulator to said pressurized container;

second coupling means for coupling an outlet of said pressure regulator to said fuel injectors;

said second coupling means including at least first and second different adapters for coupling to said fuel injectors in respective ones of said different motor vehicles; and said pressure regulator including controllable means for regulating a pressure of said mixture at said outlet to a value appropriate for a particular motor vehicle to which it is coupled.

2. A kit according to claim 1 wherein said second coupling means further includes at least first and second hoses for coupling said pressure regulator to said at least first and second adapters.

3. A kit according to claim 1 wherein said controllable means includes a pressure gauge.

4. A kit according to claim 1, further comprising:
an instruction manual;
said instruction manual including instructions for selecting and assembling a selected fuel injector cleaner assembly from contents of said kit;
said instruction manual further including instructions for coupling said selected fuel injector cleaner assembly to said motor vehicle; and
said instruction manual further including instructions for selecting and controlling said pressure to a value appropriate for said motor vehicle.

5. A kit according to claim 4, wherein:
said second coupling means includes at least first and second hoses;
said at least first and second adapters including means for adapting said first and second hoses for attachment to different motor vehicles;
said first hose having a first color;
said second hose having a second color; and
said instruction manual relating said first and second colors to first and second different motor vehicles whereby selection of said selected fuel injector cleaner assembly is simplified.

6. A kit for cleaning fuel injectors in at least first and second different motor vehicles, comprising:
a pressurized container;
a pressurized mixture of a cleaning fluid and a fuel in said pressurized container;
a pressure regulator;
first coupling means for coupling said mixture to said pressure regulator;
second coupling means for coupling said pressure regulator to one of said at least first and second different motor vehicles;
said second coupling means including at least first and second hoses and at least first and second adapters; and
said pressure regulator including adjustable means for regulating a pressure of said mixture fed to said motor vehicle to a value appropriate for said one of said at least first and second different motor vehicles.

7. A kit according to claim 6, wherein said means for regulating includes a pressure gauge.

8. A kit according to claim 6, wherein:
said pressurized container includes a first threaded seal; and
said first coupling means includes a second threaded seal adapted to engage said first threaded seal, for sealing said pressurized mixture against leakage during use.

9. A kit according to claim 8 wherein:
said pressurized container includes a valve for dispensing said cleaning fluid; and
said first coupling means includes means for actuating said valve when said first and second threaded seals are engaged.

10. A kit according to claim 6, further comprising means for blocking a fuel return line from said fuel injectors to said motor vehicle.

11. A kit according to claim 10 wherein said means for blocking includes a clamp installable for pinching off a flexible tube in said fuel return line.

* * * * *